US010773541B2

(12) United States Patent
Tolf et al.

(10) Patent No.: US 10,773,541 B2
(45) Date of Patent: Sep. 15, 2020

(54) MEDIA BINDER ARRANGEMENT AND A METHOD OF MANUFACTURING A MEDIA BINDER

(71) Applicant: BINDOMATIC AB, Stockholm (SE)

(72) Inventors: Göran Tolf, Täby (SE); Urpo Latvakangas, Saltsjö-Boo (SE)

(73) Assignee: Bindomatic AB (SE)

( * ) Notice: Subject to any disclaimer, the term of this patent is extended or adjusted under 35 U.S.C. 154(b) by 0 days.

(21) Appl. No.: 16/317,436

(22) PCT Filed: Oct. 24, 2017

(86) PCT No.: PCT/EP2017/077182

§ 371 (c)(1),
(2) Date: Jan. 11, 2019

(87) PCT Pub. No.: WO2018/103944

PCT Pub. Date: Jun. 14, 2018

(65) Prior Publication Data

US 2019/0225008 A1 Jul. 25, 2019

(30) Foreign Application Priority Data

Dec. 8, 2016 (EP) ..... 16202897

(51) Int. Cl.

| | |
|---|---|
| ***B42F 9/00*** | (2006.01) |
| ***B42B 5/06*** | (2006.01) |
| ***B42F 1/00*** | (2006.01) |

(52) U.S. Cl.
CPC ..... *B42F 9/008* (2013.01); *B42B 5/06* (2013.01); *B42F 1/006* (2013.01)

(58) Field of Classification Search
CPC ..... B42F 9/008; B42F 1/006; B42B 5/06
USPC ..... 402/4, 8, 9, 16, 18, 19, 20, 70, 71, 73, 402/74, 75, 76
See application file for complete search history.

(56) References Cited

U.S. PATENT DOCUMENTS

2008/0018089 A1* 1/2008 Hoarau ..... B42F 9/008 281/15.1
2008/0213032 A1* 9/2008 Hoarau ..... B42F 9/008 402/20

* cited by examiner

*Primary Examiner* — Justin V Lewis
(74) *Attorney, Agent, or Firm* — Wendi E. Uzar

(57) ABSTRACT

Media binder arrangement (10) comprising at least one spring clamp (15) attached to the spine (14) of the media binder. The spring clamp (15) having an interior cavity (19). The interior cavity (19) of said spring clamp (15) is additionally formed with a datum spacer cavity (35) having spacer walls (36, 37) limited from the sides (16, 17) by a bending. The spacer walls (36, 37) having wall surfaces facing the clamp base (18) for holding the datum spacer (30) in abutment with the clamp base (18). Method of manufacturing such a media binder arrangement (10).

12 Claims, 2 Drawing Sheets

MEDIA BINDER ARRANGEMENT AND A METHOD OF MANUFACTURING A MEDIA BINDER

TECHNICAL FIELD

The present invention relates to a spine clamp binder for a quick binding technique of separate sheets into booklets/folders by bending the sides of the binder backwards for the binder to open.

BACKGROUND OF THE INVENTION

The U.S. Pat. Nos. 7,798,736 and 7,922,207 each discloses a media binder arrangement having a cover with a front planar surface and a back planar surface connected by a spine planar surface. The spine planar surface includes several spine clamps each of which provides a closing force strong enough to hold a bundle of paper sheets. The clamps can be opened by a tension sheet attached to the spine clamp as well as to the cover of the media binder. When the cover is opened more than 270°, an opening force is transmitted to the spine clamps by the tension sheet. Each spine clamp is designed with planar side surfaces angled towards each other at the top of the spine clamp and connected to each other at the bottom by a planar clamp spine part. These patents also discloses that the media binders are provided with a datum spacer provided with a datum stop arranged perpendicular to and at one end of the datum spacer.

The U.S. Pat. No. 7,757,358 discloses sheet retention mechanisms for spring clamp binders having a spacer as a datum bar with a set of holes passing through the spacer and that each of the holes is aligned with holes in the spring clamp so that rivets or the like connects the spring clamp and the spacer. The spring clamps are provided with flat side surfaces which are closed at the top but can be opened against the spring force by a tension system.

In each of the previously known patents disadvantages occur in that they provide their tension sheet attached to the spring clamp by gluing, folding or riveting. These methods of attachments are time consuming and expensive.

THE OBJECTIVE OF THE INVENTION

The object of the present invention is to provide a new spine clamp for a spine clamp binder which spine clamp makes it possible to produce a spine clamp binder faster and less expensive than before.

The object of the invention is also to provide a new production method for a spine clamp binder using such new spine clamps.

SUMMARY OF THE INVENTION

By the present invention, as this is seen in the independent claims, the above-mentioned objects are met, said disadvantages having been eliminated. Suitable embodiments of the invention are defined in the dependent claims.

The invention relates to a media binder arrangement comprising a cover with a front, a back and a spine extending along a spine axis.

The arrangement comprises at least one spring clamp attached to the spine and which spring clamp having a first side with a first clamping side edge and a second side with second clamping side edge. The side edges exerting a spring force towards each other in an activated position. The sides of the spring clamp are joined together at a distance from the side edges with a clamp base thereby defining an interior cavity in the spring clamp. Each side of the spring clamp having an acute angle towards the clamp base. A tension sheet is mounted inside the cavity and protruding out from the cavity next to each of the respective side edges and firmly attached to the cover. A datum spacer is mounted inside the cavity holding the tension sheet towards the clamp base of the spring clamp wherein the interior cavity of said spring clamp additionally is formed with a datum spacer cavity having spacer walls limited from the sides of the spring clamp by a bending. The spacer walls are having wall surfaces facing the clamp base for holding the datum spacer in abutment with the clamp base. These spacer walls are formed in the respective side edges of the spring clamp at a bending in, the side edges. The datum spacer cavity is thus formed and delimited from the rest of the interior cavity by these bendings.

In an embodiment of the invention the clamp base has a flat surface.

In an embodiment of the invention the wall surfaces of said spacer walls are parallel with the surface of the clamp base. This embodiment provides for a rectangular datum spacer cavity.

In an embodiment of the invention the wall surfaces of said spacer walls each having an acute angle towards the surface of the clamp base. This provides for a clamping force for holding a bundle of papers. The more acute angle towards the clamp base the larger clamping force of a given spring clamp properties.

In an embodiment of the invention the said acute angles of the spacer wall surfaces each are different from the angles between the sides and the clamp base respectively. This means that an acute angle between a spacer wall and the clamp base is different from an acute angle between side wall and the clamp base. This provides for a datum spacer cavity of another form than the purely rectangular form.

In an embodiment of the invention a perpendicular projection of the spacer walls towards the clamp base covers from 20% to 60% of the clamp base surface. This determines the coverage of the datum spacer by the spacer cavity.

In an embodiment of the invention the said projection covers 30% to 40% of the clamp base surface.

In an embodiment of the invention the said projection covers 35% of the clamp base surface.

In an embodiment of the invention the datum spacer is provided as an elongate ruler having a rectangular cross section.

In an embodiment of the invention the elongate ruler in one end is provided with a datum stop extending perpendicular to the longitudinal direction of the ruler. This datum stop provides for an alignment of the bundle of papers in a second direction perpendicular to the clamp base.

The invention also covers a method of manufacturing such a media binder arrangement having at least one spring clamp with an interior cavity and with an additionally datum spacer cavity designed to hold a datum spacer. A tension sheet is attached to a datum spacer and then the tension sheet together with the datum spacer is inserted longitudinally into the datum spacer cavity in the spring clamp for holding the tension sheet in the datum spacer cavity of the spring clamp. Then the tension sheet is attached to a front and a back of a binder cover and at the same time the spring clamp is positioned in a spine position of the binder cover.

In an embodiment of the method the tension sheet is glued to the inside of the binder cover.

An embodiment of the method of manufacturing a media binder have the following steps:

Step 1: Form the metal spring to the described shape.
Step 2: Attach a liner to the plastic bar.
Step 3: Insert plastic bar and the liner into the metal spring.
Step 4: Glue the liner to the inside of the book cover.

BRIEF DESCRIPTION OF THE DRAWINGS

Now, the invention will be described in more detail, references being made in connection with the accompanying drawing figures. The drawing figures show only explanatory sketches intended to facilitate the understanding of the invention.

DESCRIPTION OF THE INVENTION

Figure 1:
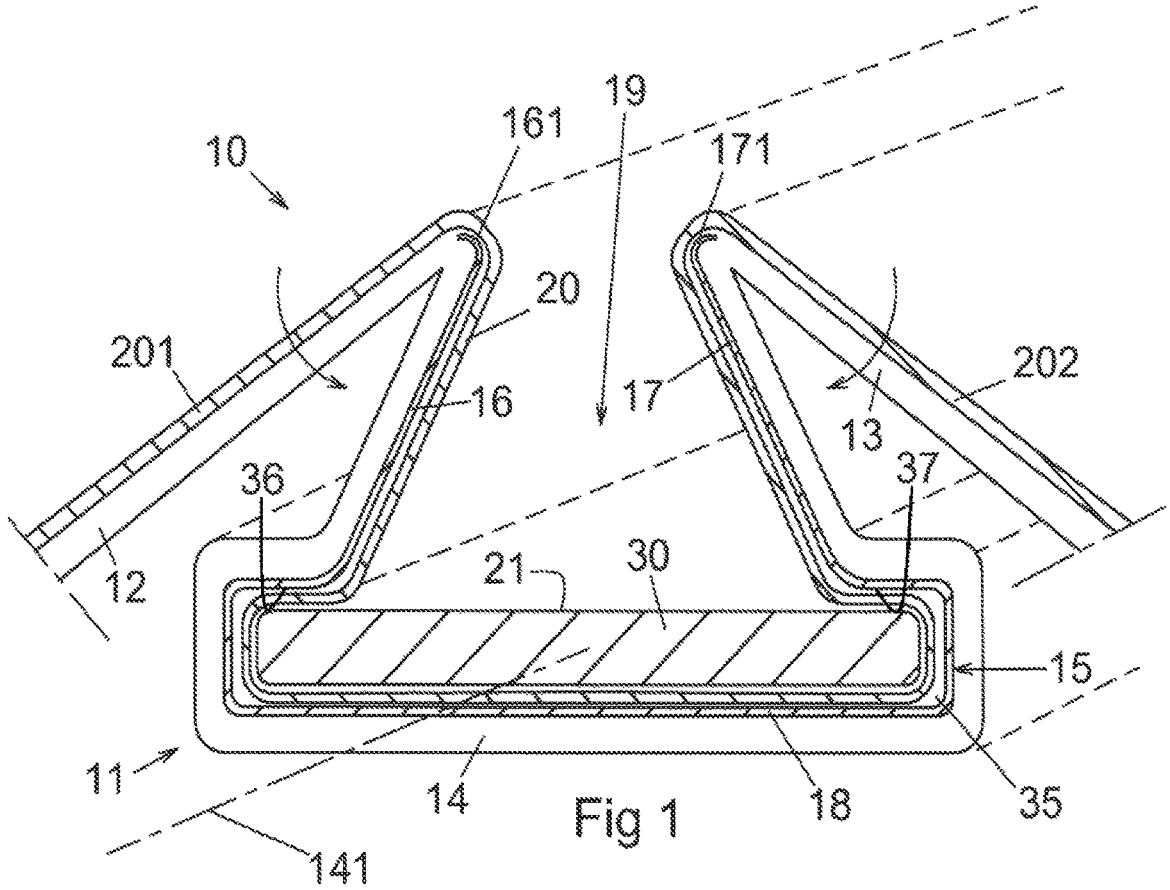
FIG. 1 shows a section of first embodiment of a spring clamp mechanism in a media binder arrangement according to the invention.

FIG. 1 shows a schematic cross sectional view of the spine region of a media binder arrangement 10. Parts of the arrangement is disclosed with dashed lines for illustrative purposes of the elongated binder arrangement. In the disclosed section the arrangement 10 comprises a cover 11 with a front part 12, a back part 13 and a spine part 14. All of these parts extends in a direction parallel to a spine axis 141 up to the actual dimension of the media binder product as is illustrated by the dashed lines in the figure. The media binder arrangement 10 is provided with a spring clamp 15 of a first embodiment which spring clamp is attached to the spine part 14 of the binder. Inside the spring clamp 15 a tension sheet 20 is applied and which tension sheet has a first side part 201 and a second side part 202. Each of these side parts of the tension sheet 20 is firmly connected to the front part 12 and to the back part 13 of the cover respectively. The connection is made so that when bending the front part 12 of the cover and the back part 13 of the cover backwards as indicated by the arrows against its closing spring force the spring clamp 15 will open. When the front part of the cover and the back part of the cover are released from its "backbending" the spring clamp will close with a certain amount of spring force. The spring clamp is disclosed in the figure in a half open position.

With such an arrangement of a spring clamp media binder, it is possible to icy collect a bundle of papers aligned in a binding position only by bending the binder backwards and thereafter let the binder close by its spring clamp.

The spring clamp 15 is provided with a first side 16 with a first clamping side edge 161 and a second side 17 with second clamping side edge 171. Each side edge 161, 171 is preferably curved outwards in order to provide a smooth surface onto which the tension sheet 20 abuts. The side edges 161, 171 are exerting a spring force towards each other in an activated position in order to press a bundle of papers together in the media binder arrangement 10. The sides 16, 17 of the media binder connects the side edges 161, 171 with a clamp base 18 at a distance from the side edges thereby defining an interior cavity 19 in the spring clamp 15. The tension sheet 20 is mounted inside the cavity 19 and is protruding out from the cavity 19 next to each of the respective side edges 161, 171 and is firmly attached to the cover 11.

Each side 16, 17 of the spring clamp 15 having an acute angle towards the clamp base 18 in an inactivated position. The interior cavity 19 at the bottom of the spring clamp 15 is designed with a spacer cavity 35. This spacer cavity is in FIG. 1 formed as a cavity with a rectangular shape having rounded corners with 90° angles between neighbouring sides. However other shapes can be chosen, for example elliptical shapes or rectangular shapes that have curved corners. The purpose of the spacer cavity is to hold a datum spacer 30 together with a tension sheet 20 in the spacer cavity. Thus, the datum spacer 30 is mounted inside the cavity 19 holding the tension sheet 20 towards the clamp base 18 of the spring clamp 15.

For this purpose the spacer cavity 35 is provided with spacer walls 36, 37 which wall surfaces are facing the clamp base 18 for holding the datum spacer 30 in abutment with the clamp base 18 even when the binder and thus the spring clamp is opened. The spacer walls 36, 37 of the spring clamp covers an inner side surface 21 of the datum spacer with 15-25% of the total inner side surface 21, preferably 20%.

Figure 2:
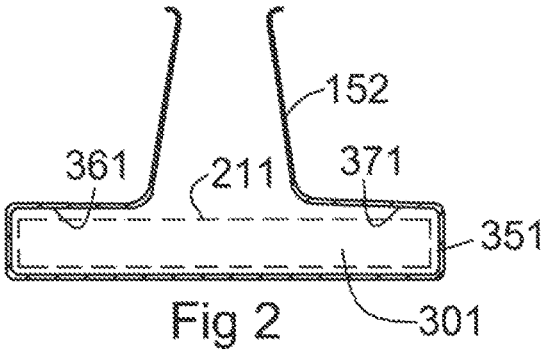
FIG. 2 shows a section of a second embodiment of a spring clamp according to the invention.

FIG. 2 shows a schematic cross sectional view of a second embodiment of a spring clamp 152 covering a datum spacer 301 schematically illustrated by dashed lines. This spring clamp 152 is provided with a spacer cavity 351 having, compared to the first embodiment, larger spacer cavity walls 361, 371 which covers an inner side surface 211 of the datum spacer with 25-75% of the total inner side surface 211, preferably 55%, when the spacer cavity walls are projected perpendicular towards the inner side surface 211 of the datum spacer 301. In this embodiment the datum spacer 301 is designed similar to the datum spacer 30 disclosed in FIG. 1.

Figure 3:
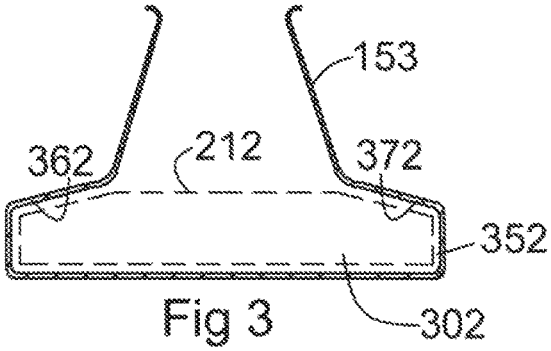
FIG. 3 shows a section of a third embodiment of a spring clamp according to the invention.

FIG. 3 shows a schematic cross sectional view of a third embodiment of a spring clamp 153 enclosing a datum spacer 302 in a spacer cavity 352 where the datum spacer is schematically illustrated by dashed lines in the figure. In this embodiment the inner side surface 212 of the datum spacer 302 is divided into three surfaces consisting of a middle surface and two sloping side surfaces. In this embodiment the spacer cavity side surfaces 362, 372 of the spring clamp 153 are parallel with the sloping side surfaces of the datum spacer 302. The spacer cavity walls 362, 372 covers the whole of the sloping side surfaces of the datum spacer when the spacer cavity walls are projected perpendicular towards the sloping side surfaces of the datum spacer 302.

Figure 4:
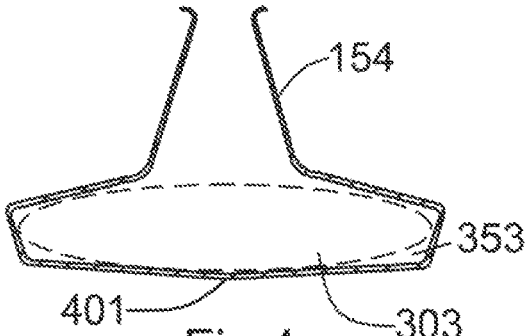
FIG. 4 shows a section of a fourth embodiment of a spring clamp according to the invention.

FIG. 4 shows a schematic cross sectional view of a fourth embodiment of a spring clamp 154 enclosing a datum spacer 303 in a spacer cavity 353 where the datum spacer is schematically illustrated by dashed lines in the figure. The cross sectional form of the datum spacer 303 is ellipsoidal. The surfaces of the spacer cavity 353 facing the datum spacer 303 is illustrated in the figure as flat surfaces, however these datum spacer facing surfaces can also be corresponding ellipsoidal in another embodiment. Moreover, the outer surface of the spring clamp is in this embodiment provided with a central bending 401.

Figure 5:
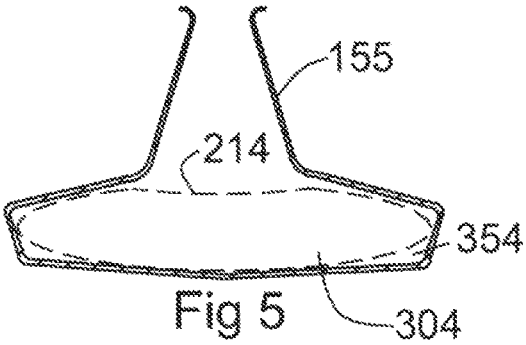
FIG. 5 shows a section of a fifth embodiment of a spring clamp according to the invention.

FIG. 5 shows a schematic cross sectional view of a fifth embodiment of a spring clamp 155 enclosing a datum spacer 304 in a spacer cavity 354 where the datum spacer is schematically illustrated by dashed lines in the figure. The cross sectional form of the datum spacer 304 is in this embodiment mainly ellipsoidal. However, a centre region of the inner surface 214 of the datum spacer is provided with an indentation of the ellipsoidal shape either as a flat surface or as a concave surface as in the figure. The surfaces of the spacer cavity 354 facing the datum spacer 304 is illustrated in the figure as flat surfaces, however these datum spacer facing surfaces can also be corresponding ellipsoidal to the datum spacer in another embodiment.

The clamp base disclosed in the embodiments might as alternative embodiments be designed concave with an inward protruding curve.

Figure 6:
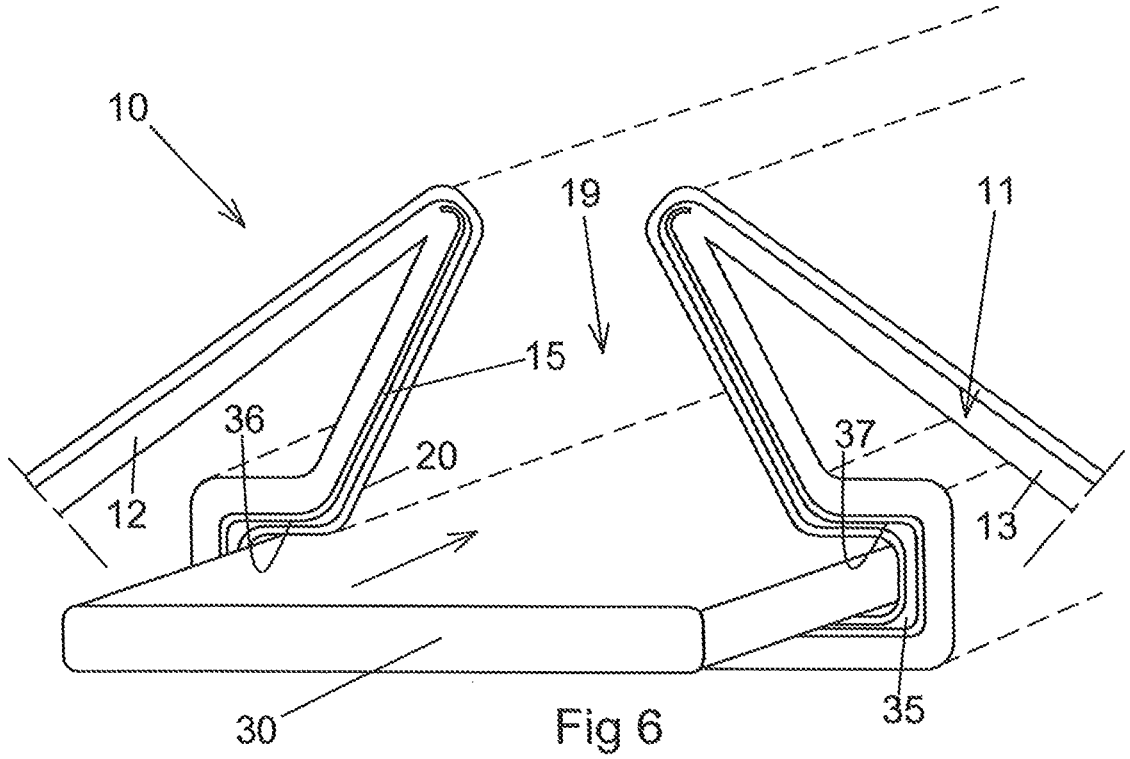
FIG. 6 shows mounting of a datum spacer into a spring clamp according to a first embodiment of the invention.

FIG. 6 illustrates a method of manufacturing a media binder arrangement 10. The media binder arrangement is provided with at least one spring clamp 15 having an interior cavity 19 designed with a datum spacer cavity 35. The datum spacer cavity 35 is formed with two spacer walls 36, 37 for holding a datum spacer 30.

A tension sheet 20 is attached to the datum spacer 30 so that both the tensioning sheet 20 and the datum spacer can be mounted into the spring clamp in a longitudinal motion illustrated by the arrow in the figure. For illustrative purposes the datum spacer ii FIG. 6 is shown longer that the tensioning sheet. Normally the tensioning sheet and the datum spacer are levelled with each other so that they can be longitudinally displaced into position simultaneously.

Thus, the tension sheet 20 together with the datum spacer 30 is inserted longitudinally into the datum spacer cavity 35 in the spring clamp 15 for holding the tension sheet in the datum spacer cavity 35. Preferably this mounting of the tensioning sheet and the datum spacer is being made while the spring clamp is forced towards opening.

When the tensioning sheet and the datum spacer is in a correct position, which means levelled with the spring clamp, the tension sheet 20 is attached to a front 12 and a back 13 of a binder cover 11. At the same time the spring clamp 15 is positioned in a spine position of the binder cover 11. Preferably the tension sheet 20 is glued to the inside of the binder cover 11.

In the disclosed FIGS. 1-6 one purpose of the datum spacer is to align the inner side of a bundle of papers towards the surface of the datum spacer.

Figure 7:
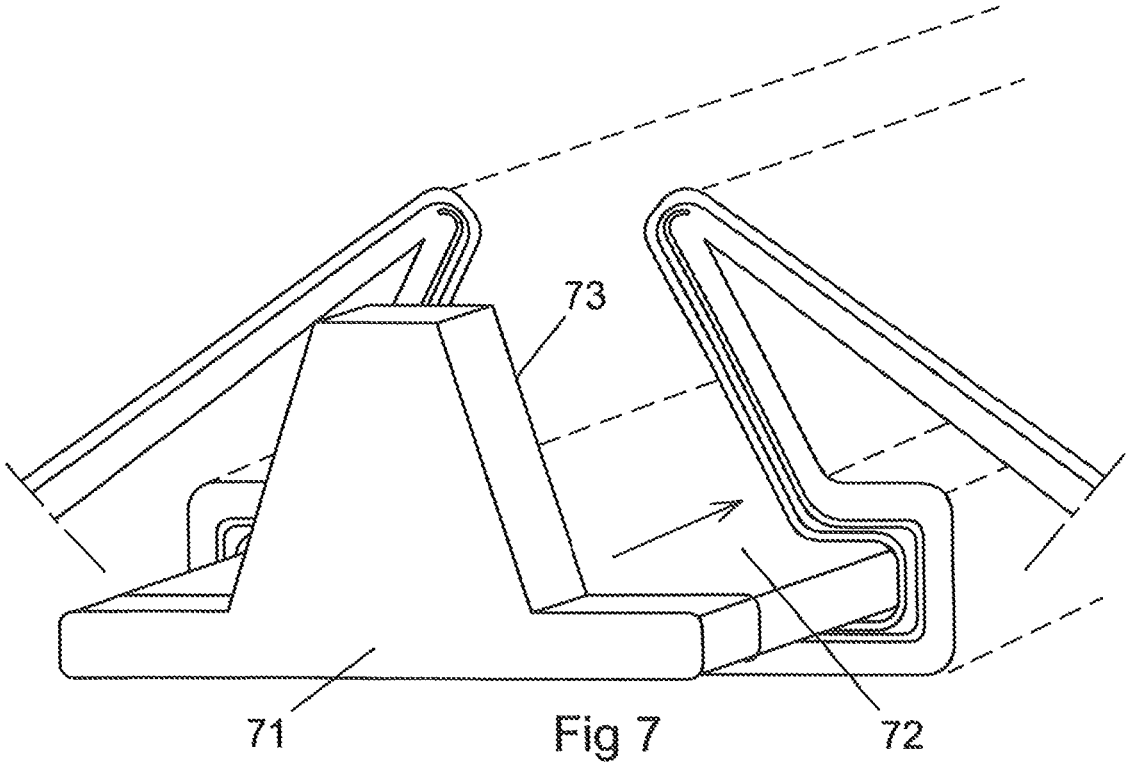
FIG. 7 shows mounting of a datum spacer of a second embodiment into a spring clamp according to the invention.

FIG. 7 discloses a mounting procedure identical to the one disclosed in FIG. 6 but with another type of datum spacer 71. This datum spacer is provided with a first side 72 similar to the datum spacers previously disclosed. However this datum spacer also have an end surface 73 extending perpendicular from the first side 72. The purpose of this end surface 73 is to also align the bundle of papers in a perpendicular direction. The longitudinal mounting described in FIG. 6 is however the same for this embodiment and illustrated by the arrow.

In all the disclosed embodiments the common design factor is that the spring clamp is designed with a clearly defined datum spacer cavity.

The invention claimed is:

1. A media binder arrangement comprising, a cover with a front, a back and a spine extending along a spine axis;

at least one spring clamp attached to the spine, said spring clamp having a first side with a first clamping side edge and a second side with a second clamping side edge, said side edges exerting a spring force towards each other in an activated position;

the sides being joined with a clamp base at a distance from the side edges thereby defining an interior cavity in the spring clamp, each side having an acute angle with respect to the clamp base;

a tension sheet mounted inside the cavity and protruding out from the cavity next to each of the respective side edges and firmly attached to the cover;

a datum spacer mounted inside the cavity holding the tension sheet against the clamp base of the spring clamp;

wherein the spring clamp is provided with spacer walls, each spacer wall being separated from a respective side by a bend in the spring clamp along an axis being parallel with said spine axis, wherein the spacer walls form a datum spacer cavity in the interior cavity of said spring clamp and wherein the spacer walls have wall surfaces facing the clamp base for holding the datum spacer in abutment with the clamp base and the spacer walls.

2. The media binder arrangement of claim 1, wherein the clamp base has a flat surface.

3. The media binder arrangement of claim 2, wherein the wall surfaces of said spacer walls are parallel with the surface of the clamp base.

4. The media binder arrangement of claim 2, wherein the wall surfaces of said spacer walls each has an acute angle with respect to the surface of the clamp base.

5. The media binder arrangement of claim 4, wherein said acute angles of the spacer wall surfaces are different from the angles between the sides and the clamp base respectively.

6. The media binder arrangement of claim 1, wherein a perpendicular projection of the spacer walls on the clamp base covers from 20% to 60% of the clamp base surface.

7. The media binder arrangement of claim 6, wherein said projection covers 30% to 40% of the clamp base-surface.

8. The media binder arrangement of claim 7, wherein said projection covers 35% of the clamp base surface.

9. The media binder arrangement of claim 1, wherein said datum spacer is provided as an elongate ruler having a rectangular cross section.

10. The media binder arrangement of claim 9, wherein one end of said elongate ruler is provided with a datum stop extending perpendicular to the longitudinal direction of the elongate ruler.

11. A method of manufacturing a media binder arrangement, comprising the steps of:

providing a cover with a front, a back and a spine extending along a spine axis;

providing at least one spring clamp configured to be attached to said spine, having a first side with a first clamping side edge and a second side with a second clamping side edge, said side edges exerting a spring force towards each other in an activated position and said sides being joined with a clamp base at a distance from said clamping side edges thereby defining an interior cavity, each side having an acute angle with respect to said clamp base, wherein said spring clamp further is provided with spacer walls, each spacer wall being separated from a respective side by a bend in said spring clamp along an axis being parallel with said spine axis, wherein the spacer walls form a datum spacer cavity in said interior cavity of said spring clamp, and wherein said spacer walls have wall surfaces facing said clamp base;

providing a datum spacer configured to be held by said wall surfaces in abutment with said clamp base and the spacer walls;

providing a tension sheet that is attached to said datum spacer;

inserting said tension sheet and said datum spacer longitudinally into said datum spacer cavity in said spring clamp for holding said tension sheet in said datum spacer cavity; and simultaneously performing the steps of:

attaching said tension sheet to said front and said back of said cover, and; and positioning said spring clamp in said spine of said cover.

12. The method of manufacturing a media binder of claim 11, wherein said tension sheet is glued to the inside of said cover.

* * * * *